US009620871B2

(12) United States Patent
Riccardi

(10) Patent No.: US 9,620,871 B2
(45) Date of Patent: Apr. 11, 2017

(54) CABLE-MOUNT SOCKET

(71) Applicant: Wilhelm Rutenbeck GmbH & Co.KG, Schalksmuehle (DE)

(72) Inventor: Oliver Riccardi, Schalksmuehle (DE)

(73) Assignee: WILHELM RUTENBECK GMBH & CO.KG, Schalksmuehle (DE)

( * ) Notice: Subject to any disclaimer, the term of this patent is extended or adjusted under 35 U.S.C. 154(b) by 0 days.

(21) Appl. No.: 15/198,985

(22) Filed: Jun. 30, 2016

(65) Prior Publication Data

US 2017/0012374 A1 Jan. 12, 2017

(30) Foreign Application Priority Data

Jul. 8, 2015 (DE) ..... 10 2015 008 632

(51) Int. Cl.
*H01R 4/28* (2006.01)
*H01R 9/24* (2006.01)
*H01R 9/11* (2006.01)

(52) U.S. Cl.
CPC ..... *H01R 9/2491* (2013.01); *H01R 9/11* (2013.01); *H01R 9/2416* (2013.01)

(58) Field of Classification Search
CPC ..... H01R 9/2491; H01R 9/2416; H01R 9/11; H01R 12/79; H01R 4/2429; H02G 5/02; G06F 1/1613
See application file for complete search history.

(56) References Cited

U.S. PATENT DOCUMENTS 4,934,953 A * 6/1990 Tenham ..... H01R 12/79 439/417
5,480,323 A * 1/1996 Mews ..... H01R 4/2429 439/395
8,934,226 B2 * 1/2015 Smith ..... G06F 1/1613 361/679.2
2014/0005678 A1 * 1/2014 Shelton, IV ..... A61B 17/07207 606/130
2014/0158395 A1 * 6/2014 Billman ..... H02G 5/02 174/68.2
2016/0248208 A1 * 8/2016 Donia ..... F16M 11/06

* cited by examiner

*Primary Examiner* — Jean F Duverne
(74) *Attorney, Agent, or Firm* — Andrew Wilford

(57) ABSTRACT

A socket assembly has a housing holds a circuit board that is provided with contacts for engagement with a data plug and a back face provided with rearwardly projecting blade contacts. A conductor spreader block engageable in a rear housing end fits with conductors of a multiconductor cable and, when fitted in the housing, electrically engages the conductors with the blade contacts, A holder in the base between the spreader block and the board has an open back side through which the block can fit. The holder forms a first U-shaped half seat, and a cover subassembly forms a second U-shaped half seat and is pivotal on the holder between an open position projecting laterally therefrom with the cable passing loosely into the housing and a closed position rearwardly closing the holder and compressing the cable between the half seats and locking the block in the holder.

10 Claims, 12 Drawing Sheets

Fig.17
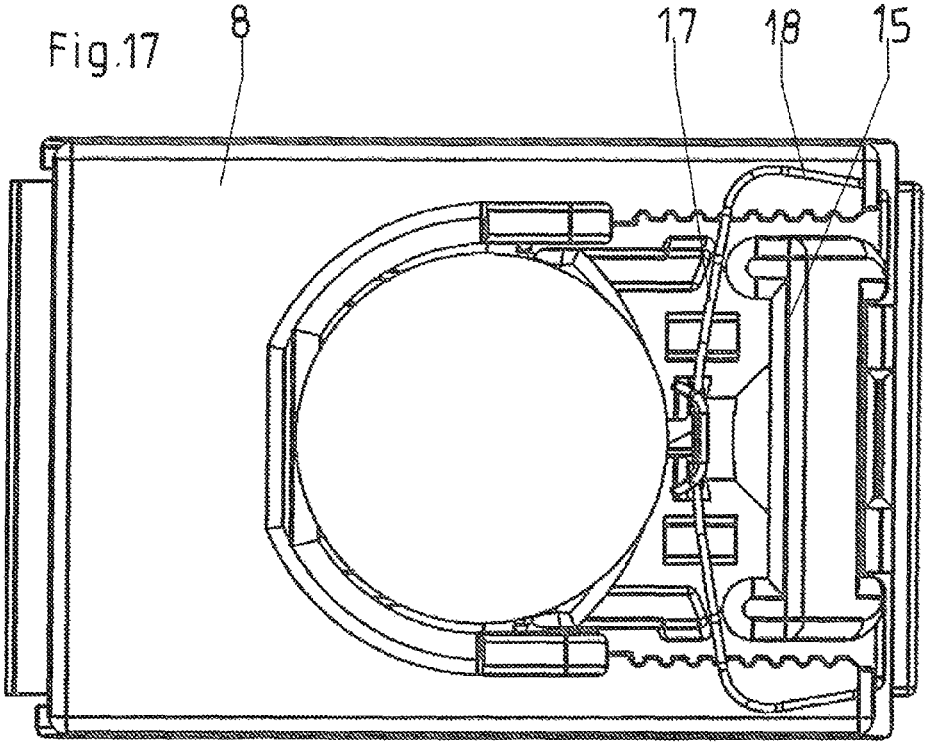
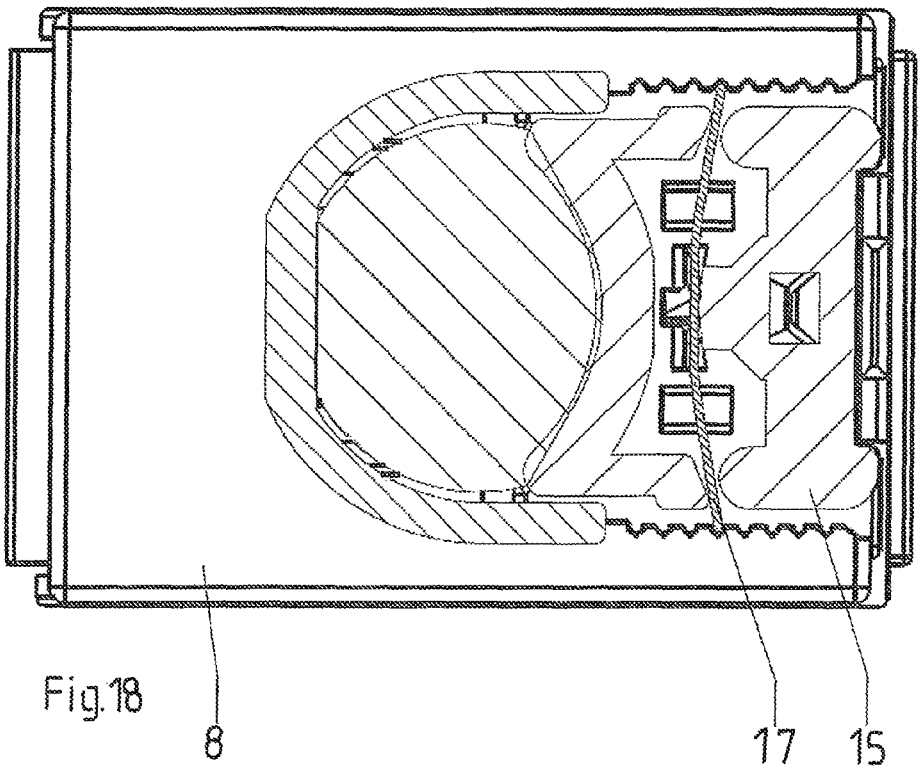
Fig.18

CABLE-MOUNT SOCKET

FIELD OF THE INVENTION

The present invention relates to a socket. More particularly this invention concerns a socket assembly intended for connection of a multiconductor cable to a multiconductor plug, for instance for transmitting data.

BACKGROUND OF THE INVENTION

A socket assembly for telecommunications and/or data transmission systems typically has a housing in which is fixed a circuit board, and blade contacts as connectors for electrical conductors of a cable accessible from a base surface of the housing. In addition, the socket assembly has a socket seat for a plug communicating with the socket assembly, and the electrical contacts contactable by contacts of the plug, contactable by the blade contacts of the plug, and electrically contacted by the blade contacts are held in the socket seat.

Such a socket assembly is known from the prior art in this field and has proved successful in principle. Such socket assemblies are usually connected to a cable with electrical conductors at a location on the housing opposite the socket seat or arranged at least at a spacing from the socket seat. In this case the electrical conductors of the cable can be arranged on a conductor spreader block that in turn is electrically in contact with further parts of the socket assembly. Such a conductor spreader block is usually connected to the blade contacts of the circuit board. For this purpose, the conductor spreader block must be fitted to the socket assembly, in particular to the housing, which in the solutions known in the prior art is time-consuming and necessitates the aid of a special tool. This is the case in particular when the socket assembly is intended to provide outstanding transmission properties for electrical signals and the like.

OBJECTS OF THE INVENTION

It is therefore an object of the present invention to provide an improved cable-mount socket.

Another object is the provision of such an improved cable-mount socket that overcomes the above-given disadvantages, in particular that, with outstanding transmission properties for electrical signals, enables a simplified connection without the aid of a special tool to the electrical conductors of a cable or to a conductor spreader block on the cable end, and that only has a limited height, is cost-effective and simple to manufacture and has a long service life.

SUMMARY OF THE INVENTION

A socket assembly has according to the invention a housing having a front end forming a socket seat for a data plug and an open back end. A circuit board is fixed in the housing between the sides and has a front face provided with contacts for engagement with the plug and a back face provided with an array of rearwardly projecting blade contacts. A conductor spreader block engageable in the rear end is adapted to fit with conductors of a multiconductor cable and to, when fitted in the housing, electrically engage the conductors with the blade contacts, A holder fitted in the base between the spreader block and the board is traversed by the blade contacts and has an open back side through which the block can fit. The holder forms a first U-shaped half seat, and a cover subassembly forms a second U-shaped half seat and us pivotal on the holder between an open position projecting laterally therefrom with the cable passing loosely into the housing and a closed position rearwardly closing the holder and compressing the cable between the half seats and locking the block in the holder.

In such a socket assembly, the cable end with a conductor spreader block arranged on it can be particularly quickly and simply inserted into the housing of the socket assembly and brought into a contact position. In this contact position the blade contacts of the circuit board contact the free ends of the electrical conductors of the cable secured to the conductor spreader block. As a result, an outstanding transmission of electrical signals is possible with simultaneously extremely low susceptibility to malfunction due to external influences. Moreover, such a socket assembly is particularly compact and thus has an extremely small size, so that for example the arrangement of such a socket assembly in a flush-mounted variant, in particular inside or as a component of a flush-mounted box, is possible.

When the cable with the conductor spreader block on its end is brought into the contact position in which the blade contacts of the circuit board are in contact with the free conductor ends of the cable, in a first step the cable is laid in the approximately U-shaped seat of the cover subassembly, and the conductor spreader block is in a preassembled position in front of the housing. Then the cover subassembly of the socket assembly is pivoted toward the housing and thus the conductor spreader block is positively guided into the contact position. In this position, the conductor spreader block is fitted into the wire holder located inside the housing of the socket assembly, and the blade contacts contact the ends of the conductors of the cable. In this case the cover subassembly rests on the conductor spreader block and holds it in the contact position.

It may be particularly preferably provided that a side wall the wire holder has a hole through which an actuating arm projecting from the cover subassembly passes, the actuating arm being positioned in the insertion path of the conductor spreader block in the open position of the cover subassembly such that when the conductor spreader block is inserted into the wire holder the conductor spreader block pivots the actuating arm and thus the cover subassembly about the pivot pin out of the open position at least almost into the closed position, and in the closed position the actuating arm is near the base of the wire holder between the two rows of blade contacts.

The provision of such a projecting actuating arm on the cover subassembly enables enforced movement of the cover subassembly into the wire holder of the housing during introduction of the cable end with the conductor spreader block arranged thereon. Thus during the introduction of the conductor spreader block into the wire holder and movement of the cable ends into the contact position with the blade contacts, the conductor spreader block first of all strikes the actuating arm of the cover subassembly, which is still pivoted up, and, during introduction of the conductor spreader block into the wire holder, causes the cover subassembly to pivot about the pivot pin of the housing into a position near to the closed position, simultaneously pivoting in the first seat half.

Moreover, in the assembled position a cable half-clip provided on the cover subassembly of the wire holder and a second half seat of the half-clip press the cable against the base of the U-shaped first half seat and thus form a strain relief for the cable passed through the cover subassembly.

Such a cable half-clip, which in the assembled position is provided on the cover subassembly and is connected thereto, presses the cable projecting from the conductor spreader block against the base of the U-shaped seat of the cover subassembly, so that strain relief for the cable passed through the cover subassembly is formed in this region. Moreover, as a result the cover subassembly is fixed in the closed position. Thus before fastening of the cable half-clip and clamping of the fed-through cable, the cover subassembly must be brought completely into the closed position. This takes place, for example, by pressing the cover subassembly against the housing using an appropriate standard tool, for example universal pliers or a pipe wrench. Such tool is not regarded as a special tool, since usually a user will always keep such a tool on site or carry it with him.

In addition the cable half-clip has an approximately semicircular second U-shaped clamping face which supplements the first U-shaped seat face of the cover subassembly to produce an approximately circular shape and with its arms engages between the arms of the U-shaped seat. Furthermore the cable half-clip has guide and latch means that allow movement of the cable half-clip longitudinally of the arms and can be fixed on the cover subassembly by means of latching.

the latching means and guide means arranged in the region of the arms the cable half-clip can be brought manually into a position in which it already exerts slight pressure on the cable and thus presses the cable against the base of the U-shaped seat of the cover subassembly. Next the cable half-clip is pressed into the assembled position with the same pliers with which the cover subassembly is fixed on the housing. In this case, during pressing with the aid of pliers the latching means, both of the cover subassembly and also of the cable half-clip, arranged in the region of the arms engage in one another and latch with one another in order to effect a secure grip of the cable half-clip on the cover subassembly.

In this case it may also be particularly preferably provided that a leaf spring is fixed on or in the cable half-clip and cooperates with latching contours on the arms of the U-shaped seat of the cover subassembly, and that handling projections serve for releasing the leaf spring.

An appropriately shaped leaf spring is the spring element and passes through the cable half-clip to cooperate with corresponding latching contours on the arms of the U-shaped seat of the cover subassembly and thus fix the cable half-clip on the cover subassembly and fix the parts to one another on the housing in the use position. Moreover, in this case the cable half-clip presses the fed-through cable against the base of the U-shaped seat of the cover subassembly, so that strain relief for the cable passed through the cover subassembly is effected in this region.

In order to prevent sliding of the fed-through cable through the U-shaped seat of the cover subassembly and the cable half-clip and at the same time to improve the strain relief, it may be particularly preferably provided that the approximately semicircular clamping face of the cable half-clip and the region on and near to the base of the U-shaped seat of the cover subassembly have barbs or retaining projections which project toward the cable and in the use position engage in the outer sheath of the fed-through cable.

Due to the arrangement of such barbs, which in the use position engage in the outer sheath of the fed-through cable, the strain relief and thus the grip of the cable securely in position between the cover subassembly and the cable half-clip is increased or ensured.

Furthermore, the cable half-clip is provided on a latch connected to the conductor spreader block and projects laterally outward therefrom in a preassembled position.

The provision of such a latch ensures that at any time the cable half-clip required for clamping of the cable relative to the U-shaped seat of the cover subassembly is included or provided. Thus for the user on site the number of parts to be carried is limited to only one part. If required, the cable half-clip carried on the latch only has to be moved by the user out of the preassembled position, which is not needed, into a use position in which the cable half-clip presses the fed-through cable relative to the base of the U-shaped seat of the cover subassembly and in which the guide means of the cable half-clip are in engagement with the guide means of the cover subassembly, so that after subsequent pressing of the cable half-clip with the cover subassembly the cover subassembly is secured in position and forms the strain relief for the fed-through cable.

Furthermore, the pivot pin is arranged near to or at the side of the housing near the open base. In particular, the wire holder and the conductor spreader block are made of plastic. Finally, the housing, the cover subassembly and the cable half-clip are made of metal, in particular of zinc.

The construction of the housing, the cover subassembly and the cable half-clip of metal enables a particularly effective protection against disruptive external influences and thus increases the shielding of the conductive parts located inside the housing such as, for example, the blade contacts and the free ends of the conductors of the cable. Thus, in this way, the inner part of the housing is in particular shielded and the socket assembly is improved with regard to the transmission properties for electrical signals.

BRIEF DESCRIPTION OF THE DRAWING

The above and other objects, features, and advantages will become more readily apparent from the following description, reference being made to the accompanying drawing in which:

FIG. 17 shows a socket assembly viewed from the rear cable end with a leaf spring in the latching position;

FIG. 18 is a view like FIG. 17 but shows the parts in section;

SPECIFIC DESCRIPTION OF THE INVENTION

Figure 7:
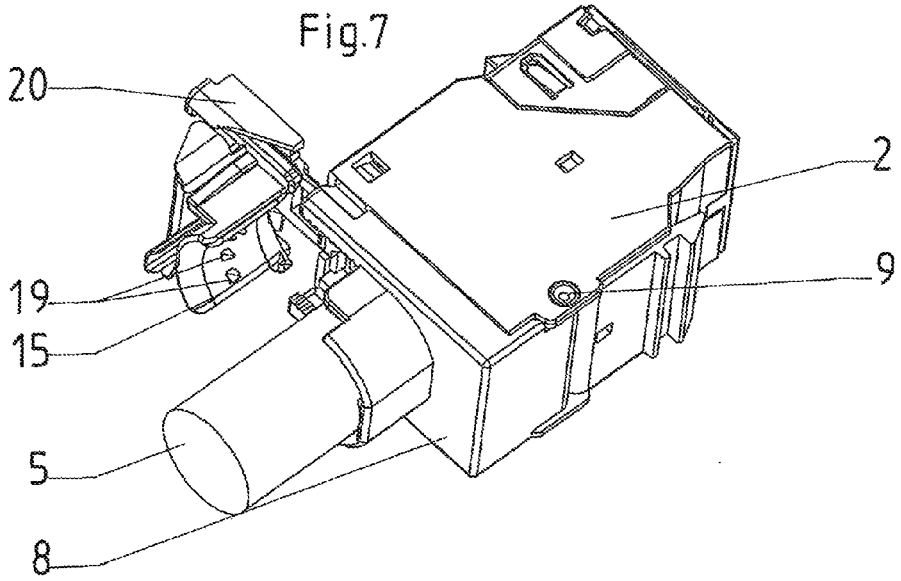
FIGS. 7, 8, and 9 are further view of the cable half-clip in the pre-assembly, intermediate, and final assembled position.
Figure 8:
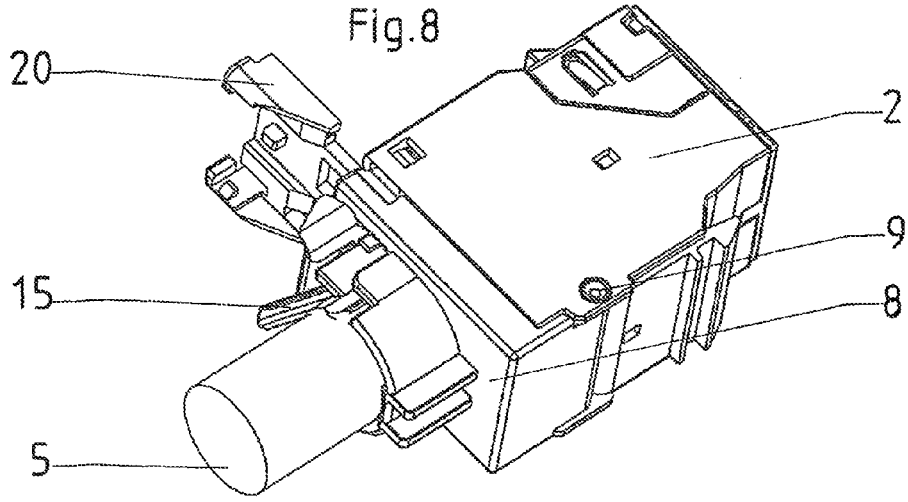
Figure 9:
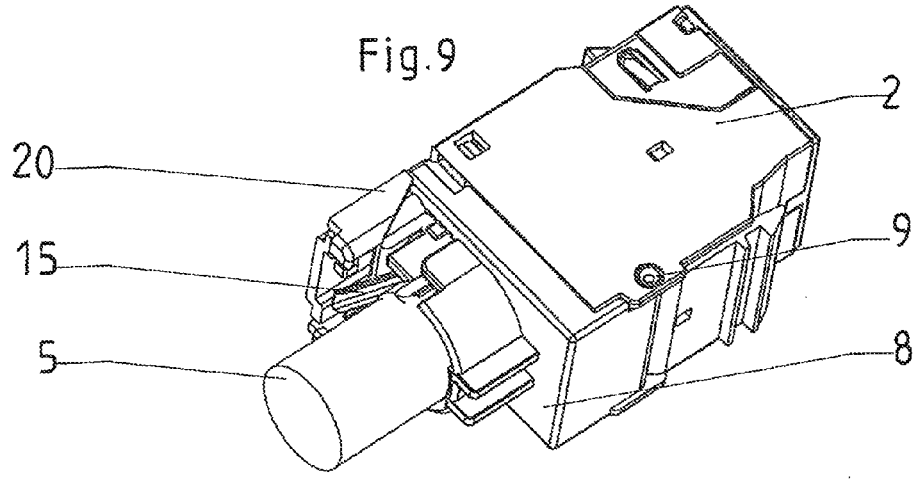
Figure 10:
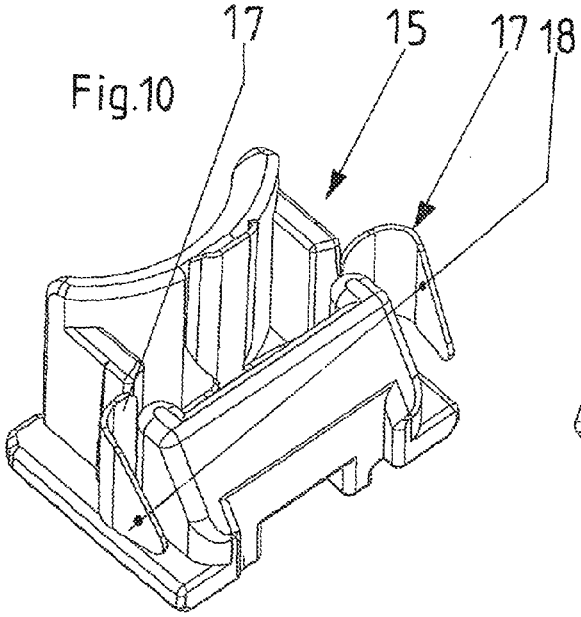
FIGS. 10 to 13 are various detail views of the cable half-clip.
Figure 11:
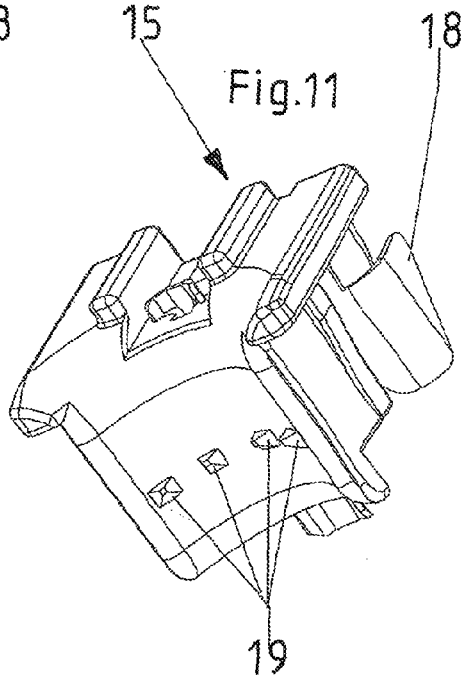
Figure 12:
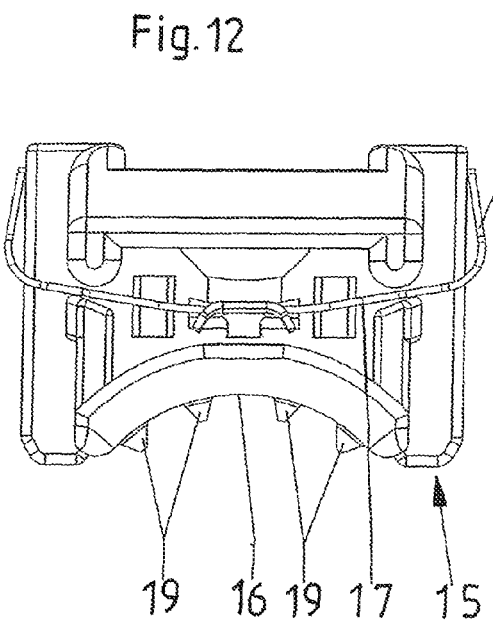
Figure 13:
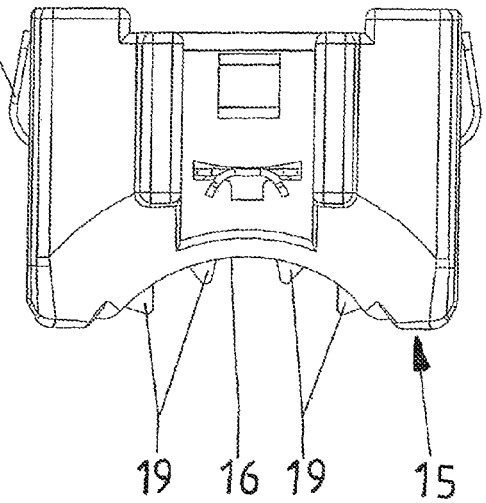
Figure 14:
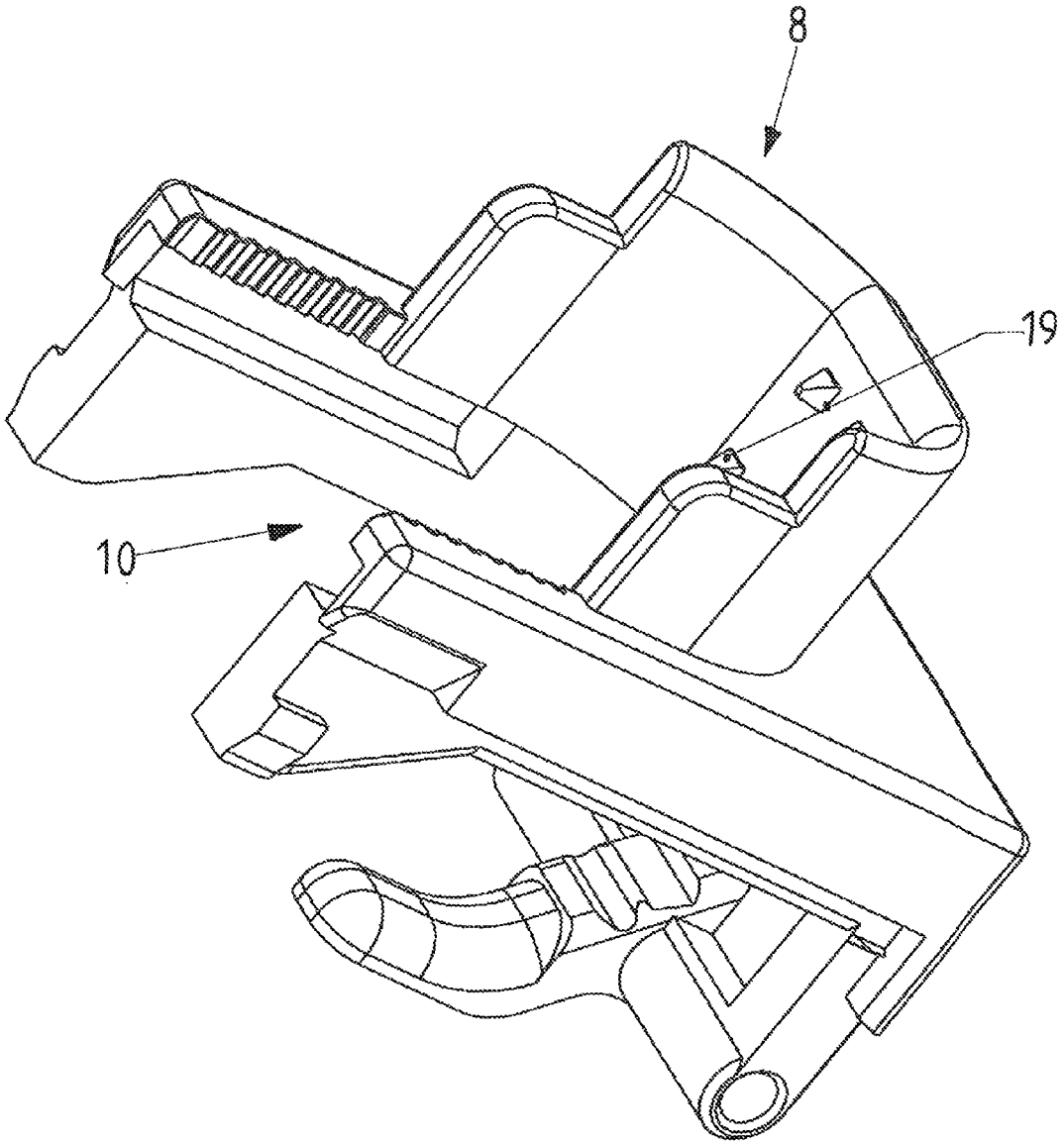
FIG. 14 is an oblique view from above of a cover subassembly according to the invention.
Figure 15:
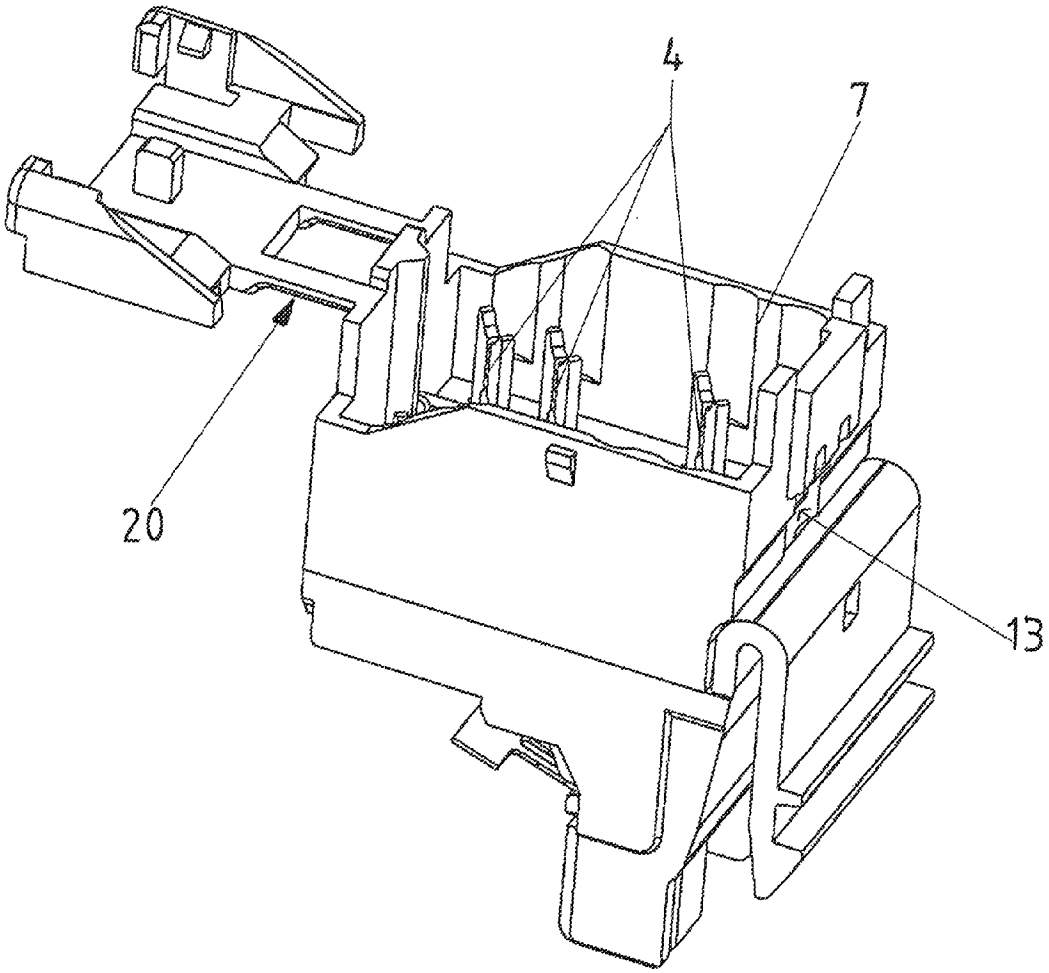
FIG. 15 is a perspective view of a wire holder with latch for a cable half-clip.

A socket assembly 1 for telecommunications and/or data-transmission systems has a housing 2 in which is fixed a circuit board 3 carrying blade contacts 4 as connectors for electrical conductors of a cable 5 (FIGS. 7-9). The cable 5 is connected at a back side of the housing 2, and the opposite front side is formed with a socket seat 6 for an unillustrated plug, for example of RJ45 construction. Electrical contacts of the board 3 are exposed in the socket seat 6 and are engageable with contacts of the unillustrated plug on the one hand and connected to the blade contacts 4 of the board 3 on the other hand.

The housing 2 is basically of rectangular cross section and tubular. The blade contacts 4 project toward the rear open end. In this case the blade contacts 4 extend through the base of a generally cubical contact holder 7 fitted in the opening of the housing 2. In this case the wire holder 7 is open on the side opposite the base of the wire holder 7 and has a pivotable cover subassembly 8. The cover subassembly 8 is pivotable about a pivot pin 9 mounted on the housing 2 between a first open position projecting from the wire holder 7 and the housing 2 and a closed position at least partially covering the wire holder 7 and the housing 2. In this case the cover subassembly 8 has an approximately U-shaped seat 10 for passage of the cable 5 with a conductor spreader block 11 carried on the cable end. In the assembled position, the conductor spreader block 11 is fitted into the wire holder 7 and the blade contacts 4 engage either contacts on the conductor spreader block 11 or the cable ends 12.

Figure 19:
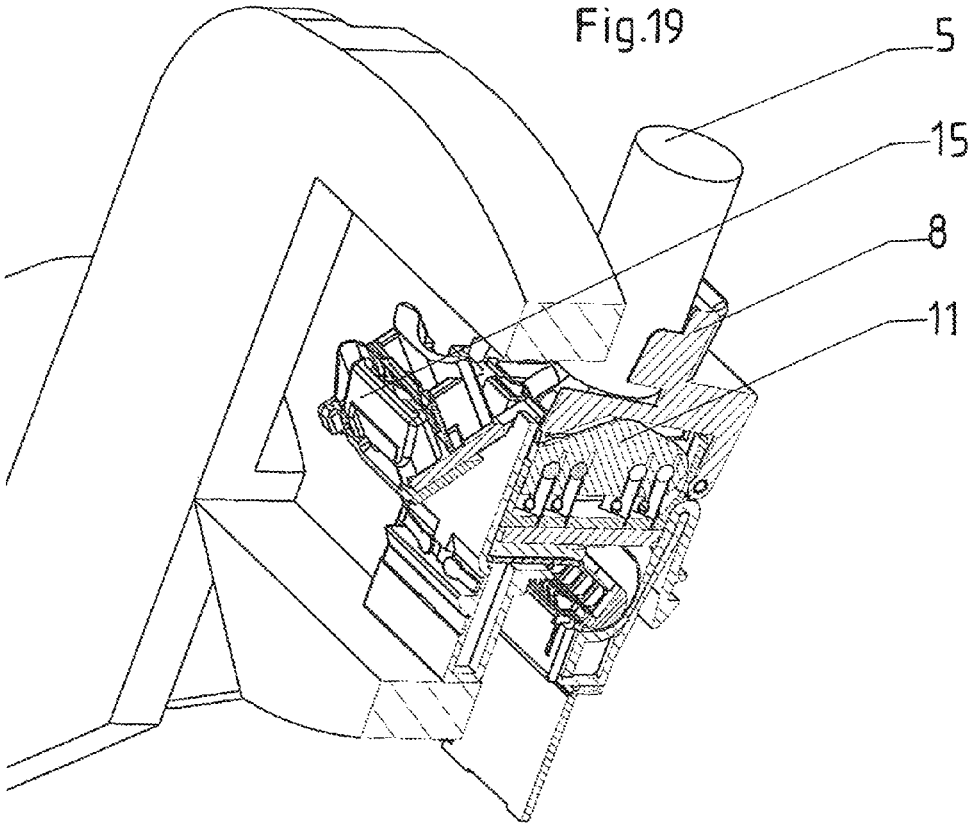
FIG. 19 shows partly in section the use of pliers for fixing the cover subassembly on the housing obliquely from above.
Figure 20:
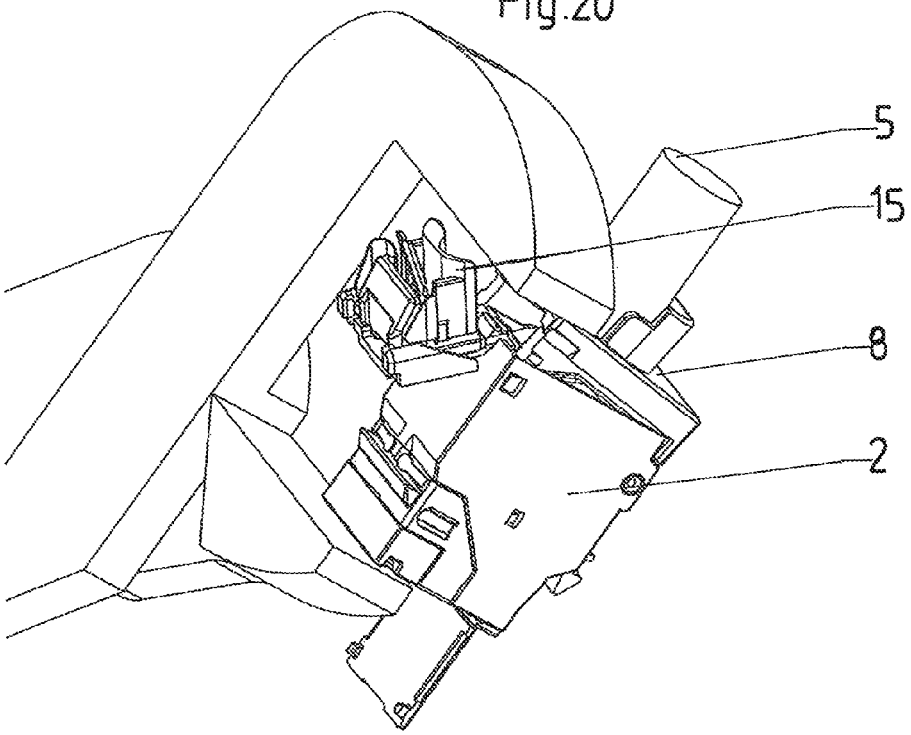
FIG. 20 is a view like FIG. 19 but not in section.

The wire holder 7 has a side wall formed with a hole 13 through which an actuating arm 14 projecting from the cover subassembly 8 passes. In the open position of the cover subassembly 8 the actuating arm 14 is positioned in the insertion path of the conductor spreader block 11 in such a way that when the conductor spreader block 11 is inserted into the wire holder 7 the conductor spreader block 11 pivots the actuating arm 14 and thus the cover subassembly 8 about the pivot pin 9 out of the open position at least almost into the closed position. This position, almost pivoted into the closed position, can be seen in particular from FIGS. 19 and 20.

After pivoting of the cover subassembly 8 into the closed position or into the position almost at the closed position near the base of the wire holder 7, the actuating arm 14 is between the two rows of blade contacts 4.

Figure 21:
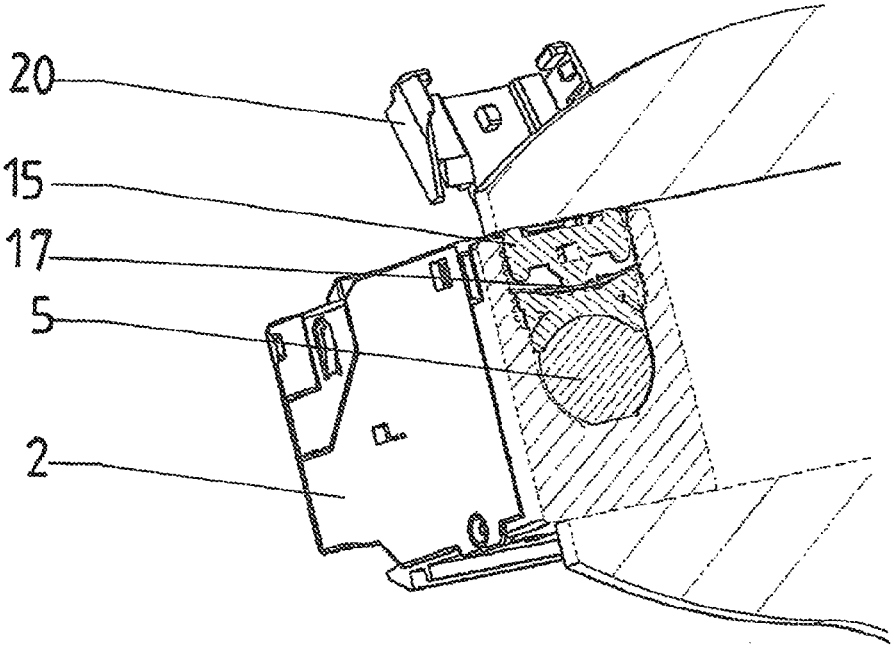
FIG. 21 shows the application of pliers for clamping the cable half-clip to the cover subassembly.
Figure 22:
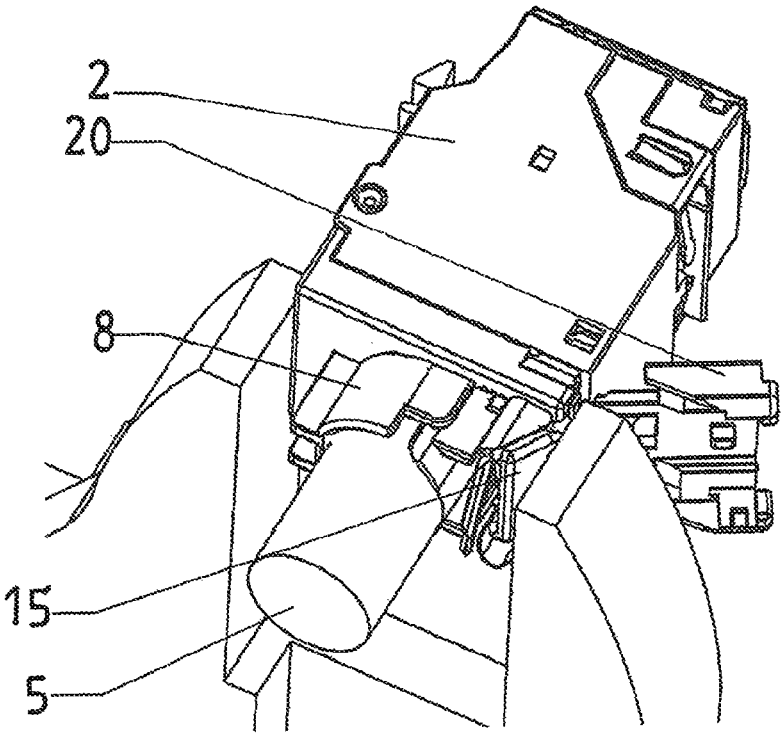
FIG. 22 is a view like FIG. 21 but with a different view.
Figure 23:
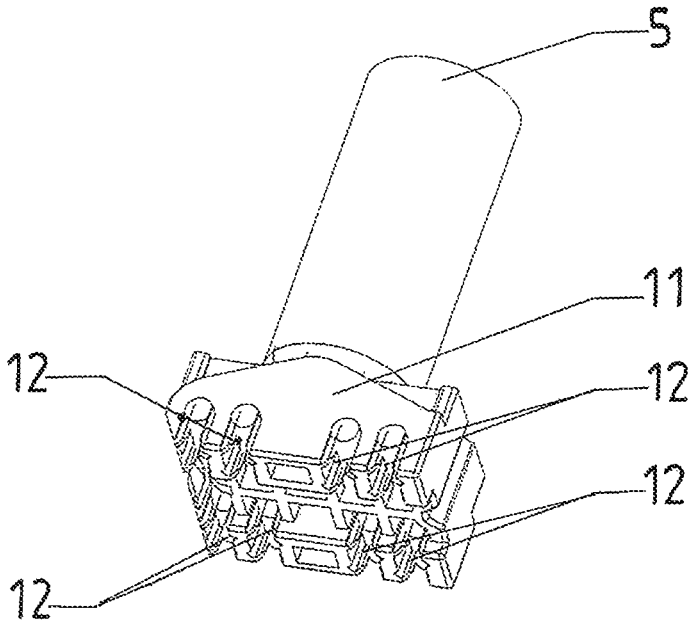
FIG. 23 shows a cable end carrying a conductor spreader block.

In the use position a cable half-clip 15 is on the cover subassembly 8 of the wire holder 7 presses the cable 5 into the U-shaped seat 10 and thus forms a strain relief for the cable 5 where it passes through the cover subassembly 8. The user on site manually moves the cable half-clip 15 into a position in which the cable 5 is slightly compressed and is pressed slightly against the base of the U-shaped opening 10 in the cover subassembly 8. Then, using a commercially available tool, such as can be seen in particular from FIGS. 21 and 22, the user can press the cable half-clip 15 on the cover subassembly 8 in such a way that in the position closest to the U-shaped seat the half-clip clamps the fed-through cable 5 between the base of the U-shaped seat 10, on the one hand, and an approximately semicircular clamping face 16 of the cable half-clip, on the other hand, in order to form this strain relief for the fed-through cable 5. In this case the approximately semicircular clamping face 16 of the cable half-clip 15 complements the U-shaped seat 10 of the cover subassembly 8, in particular the base of the U-shaped seat 10, to produce an approximately circular shape, and the arms of the semicircular clamping face 16 engage between the arms of the U-shaped seat 10. Moreover, in the region of the arms both of the cable half-clip 15 and also of the U-shaped seat 10 there are guide and latching formations that allow the cable half-clip 15 to moved parallel to the arms and latch it on the cover subassembly 8.

Furthermore, a leaf spring 17 is fixed on the cable half-clip 15. The leaf spring 17 cooperates with latching formations on the arms of the U-shaped seat 10 of the cover subassembly 8 in such a way that the cable half-clip 15 is retained in the clamped assembled position on the cover subassembly 8 and both the cover subassembly 8 and also the cable half-clip 15 are fixed on the housing 2.

Figure 16:
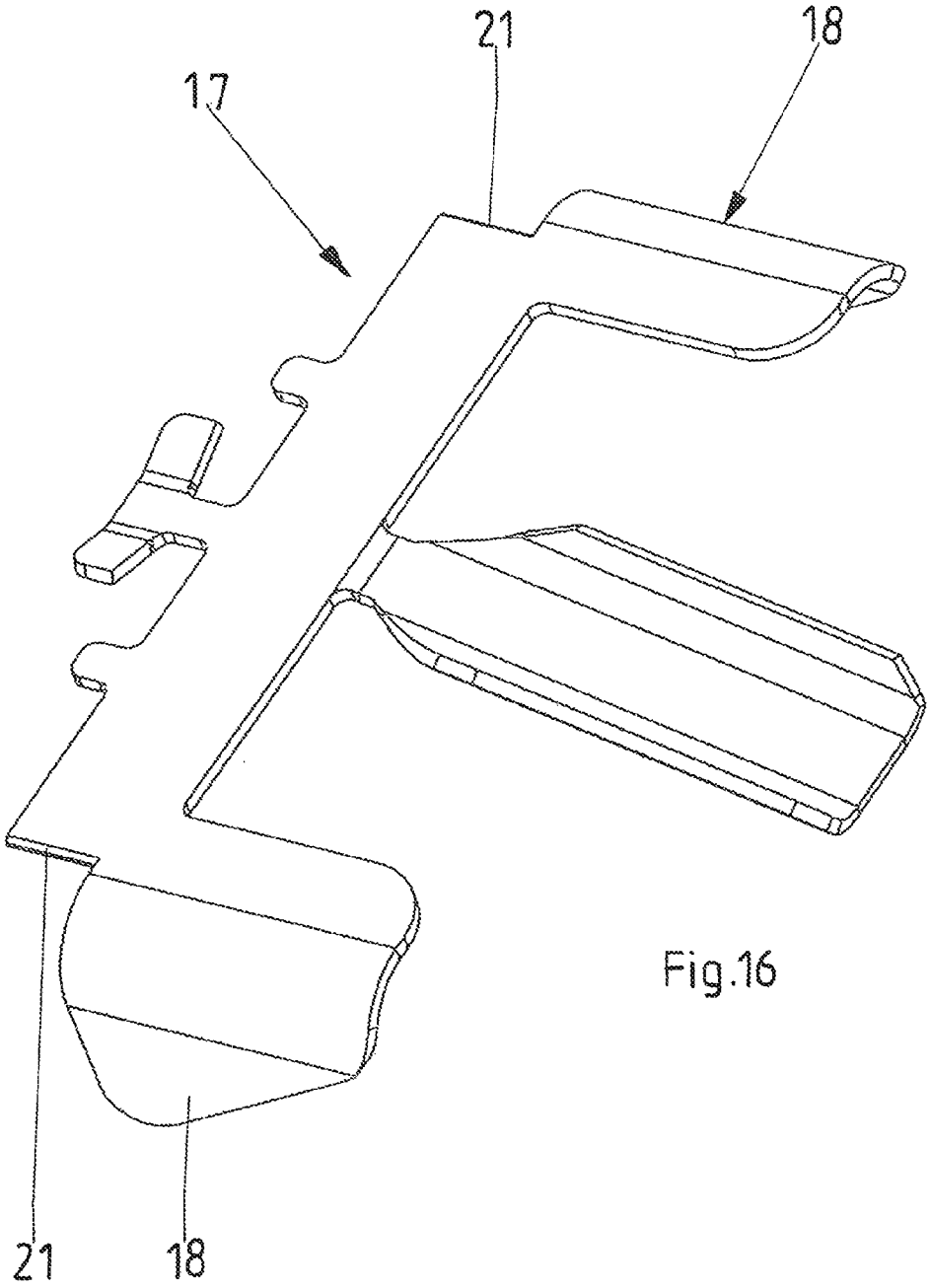
FIG. 16 shows a leaf spring according to the invention.

Moreover, as can be seen in particular from FIG. 16 and FIG. 17, handling projections 18 formed on the spring 17 can be actuated to release the leaf spring 17 from the latching position. For this purpose, in order to release the leaf spring 17, it is merely necessary for the user to press the handling projections 18 together with his/her actuating arms so that latching edges 21 of the leaf spring 17 are no longer in engagement with corresponding latching projections on the cover subassembly 8 or the arms of the U-shaped seat 10 of the cover subassembly 8.

In order to increase the strain relief, barbs 19 projecting toward the cable 5 are formed on the approximately semicircular clamping face 16 of the cable half-clip 15 and on a region on or close to the base of the U-shaped seat 10 of the cover subassembly 8. In this case in the use position, that is to say the clamping position, the barbs 19 engage in the outer sheath of the cable 5 in order to secure it in this position and to increase the strain relief.

Figure 1:
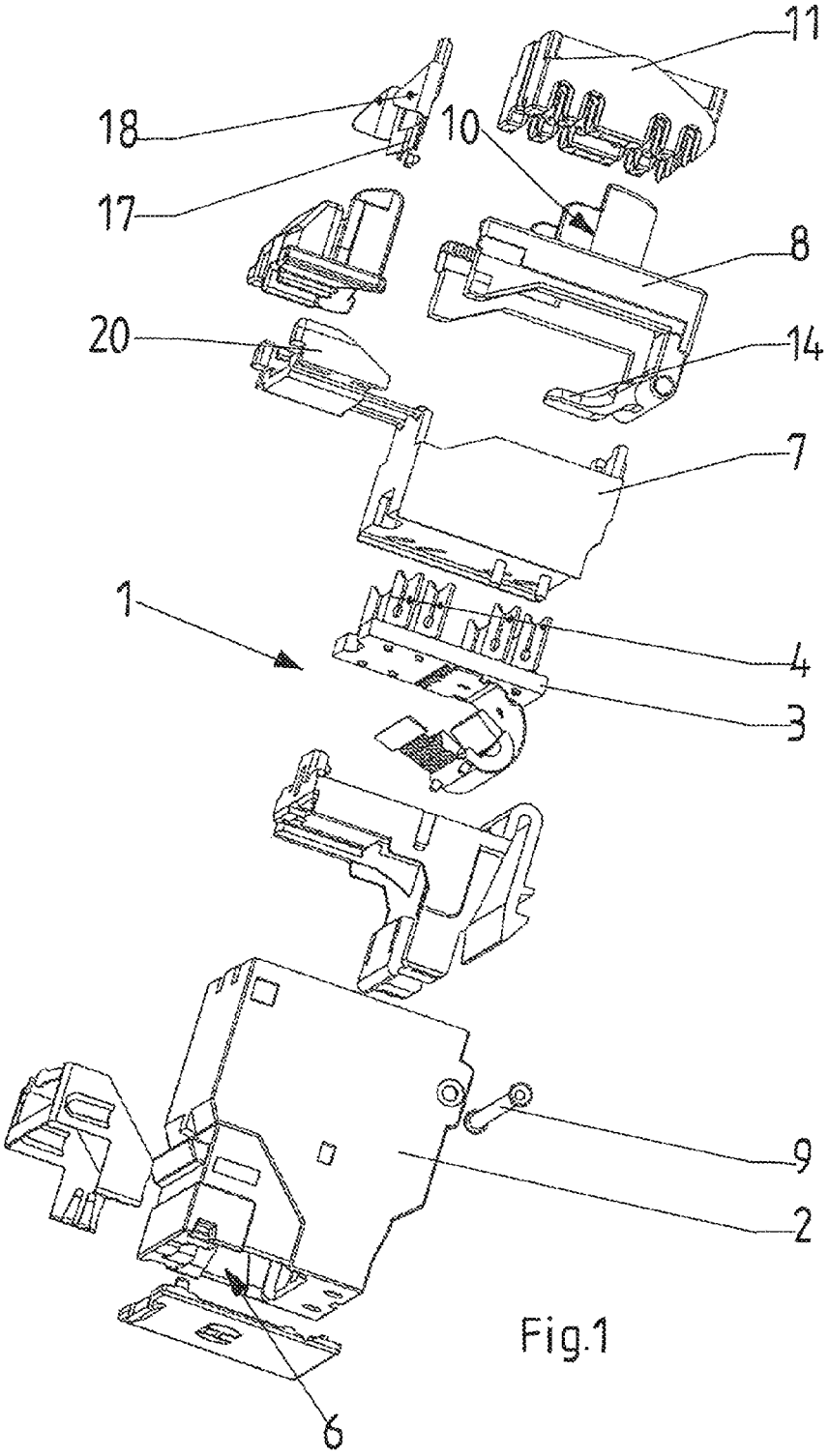
FIG. 1 is an exploded view of a socket assembly according to the invention.
Figure 2:
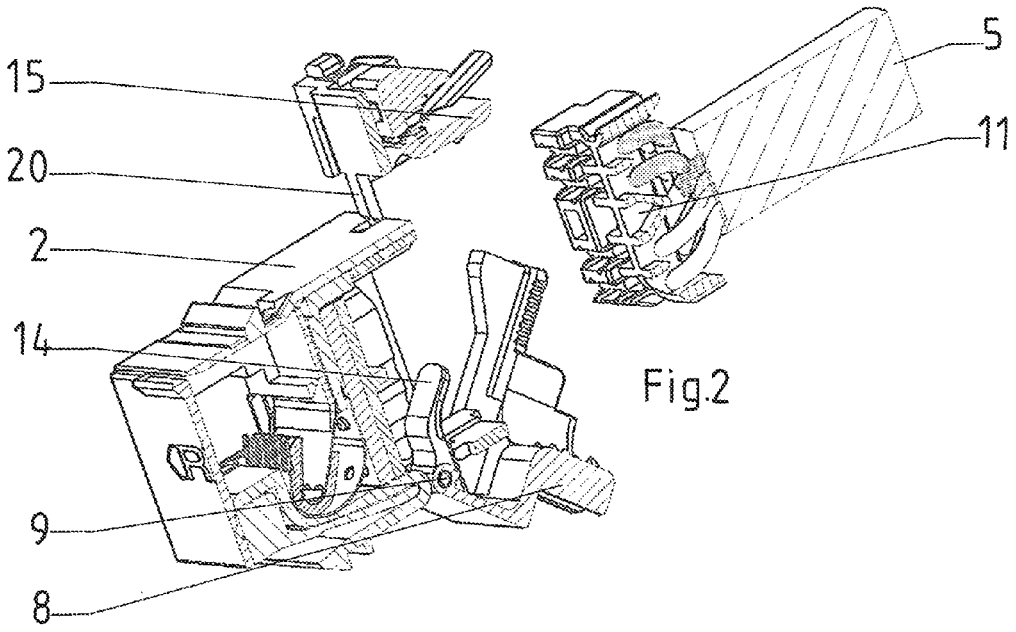
FIG. 2 is a sectional view from above of a socket assembly with cable and conductor spreader block in a preassembled position.
Figure 3:
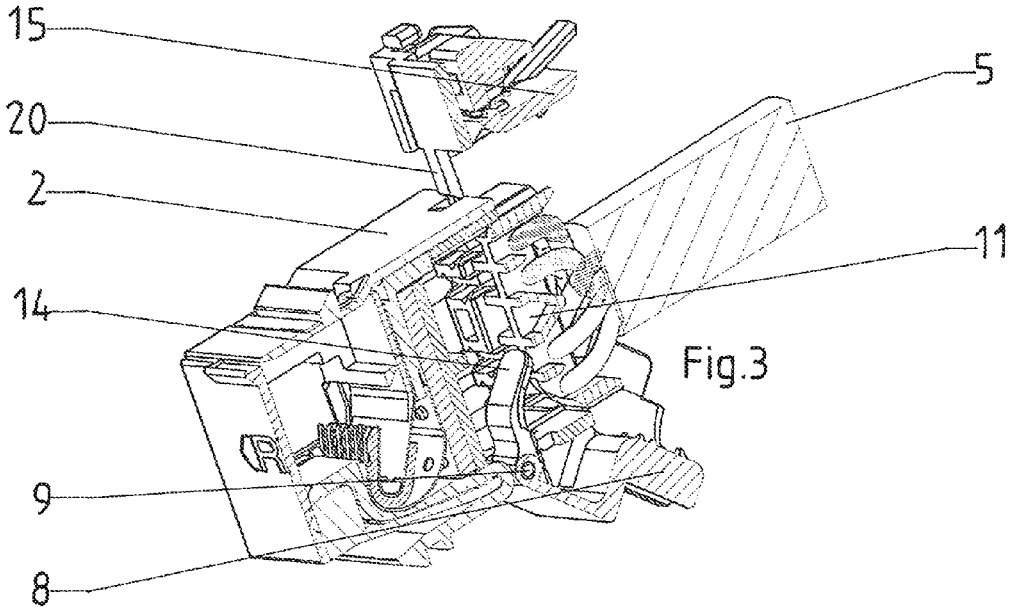
FIG. 3 is a view like FIG. 2 but in a further position.
Figure 4:
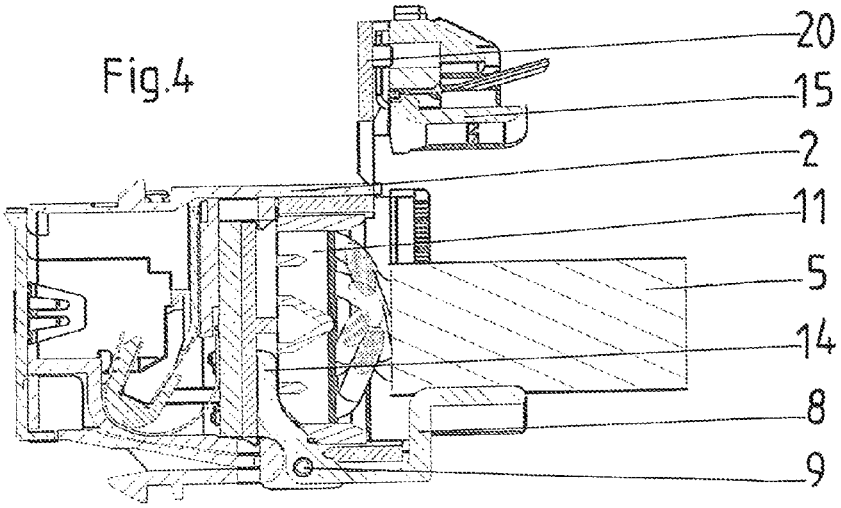
FIGS. 4 to 6 are side sectional views of the socket assembly according to the invention in different positions of the cable half-clip.
Figure 5:
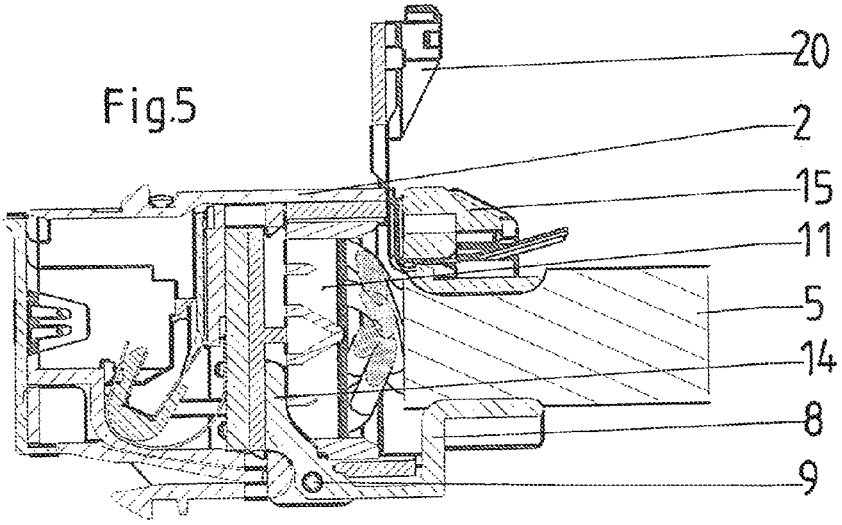
Figure 6:
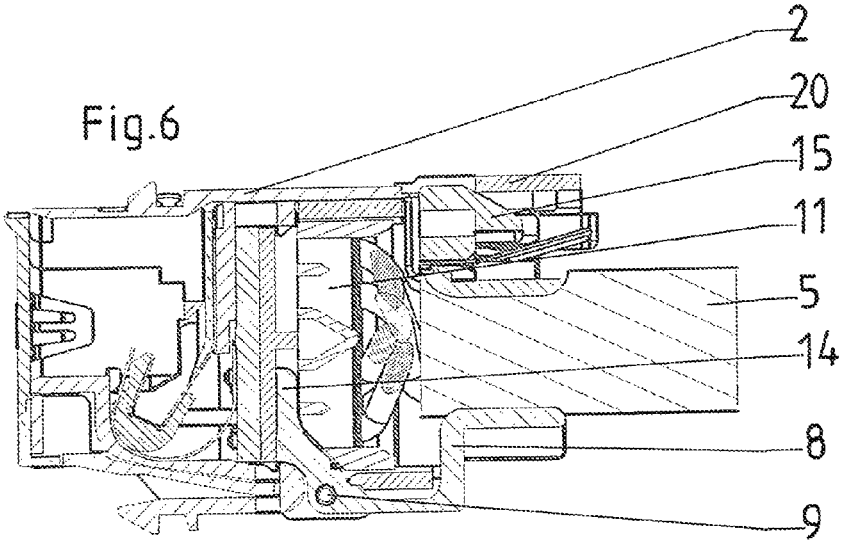

For simplified fitting of the cable half-clip 15 and in order to reduce the number of parts carried by the user, a latch 20 forming a support for the cable half-clip 15 is provided on each wire holder 7. In the preassembled position, the latch 20 projects laterally outward from the wire holder 7, and in the assembled position, as shown in particular in FIGS. 6 and 9, is pivoted toward the cable 5 into a position approximately parallel to the cable 5. There the latch 20 can cover and protect the cable half-clip 15 toward the outside and, if appropriate, can be latched in this position with the cable half-clip 15.

As can be seen in particular from FIGS. 1 to 9, the pivot pin 9 is arranged near the side of the housing 2, near the open base of the housing 2.

In the illustrated embodiment the wire holder 7 and the conductor spreader block 11 are made of plastic and the housing 2, the cover subassembly 8 and the cable half-clip 15 are made of a metal to provide good shielding against radiation, zinc in the illustrated embodiment.

In this way the socket assembly 1 is shielded as far as possible against disruptive radiation and is improved with regard to transmitting electrical signals.

Such a socket assembly 1 according to the invention has a particularly compact construction that enables it to also be used in flush-mounted boxes. In addition, due to the design-related arrangement of the cover subassembly 8 in combination with the cable half-clip 15, outstanding strain relief is provided for the cable 5 introduced into the housing 2, so that the service life is increased and a long-lasting operation of a socket assembly 1 is made possible.

Moreover, a cable 5 with a conductor spreader block 11 arranged at the cable end can be connected to such a socket assembly 1 particularly quickly and simply by a user on site, without requiring a special tool. In order to bring the components into the assembled position (use position) only commercially available pliers are required, which a user will usually have with him on site. See FIGS. 19 and 20.

The invention is not limited to the illustrated embodiment, but can be varied in many ways within the scope of the disclosure.

All individual features and combinations of features disclosed in the description and/or drawings are regarded as essential to the invention

I claim:

1. A socket assembly comprising:

a housing having a front end forming a socket seat for a data plug and an open back end;

a circuit board fixed in the housing between the ends and having a front face provided with contacts for engagement with the plug and a back face provided with an array of rearwardly projecting blade contacts;

a conductor spreader block engageable in the rear end and adapted to fit with conductors of a multiconductor cable and to, when fitted in the housing, electrically engage the conductors with the blade contacts;

a holder fitted in the base between the conductor spreader block and the board and traversed by the blade contacts and having an open back side through which the conductor spreader block can fit, the holder forming a first U-shaped half seat; and a cover subassembly forming a second U-shaped half seat and pivotal on the holder between an open position projecting laterally therefrom with the cable passing loosely into the housing and a closed position rearwardly closing the holder and compressing the cable between the half seats and locking the conductor spreader block in the holder.

2. The socket assembly defined in claim 1, wherein a side wall of the wire holder is formed with a hole and the cover assembly is formed with an actuating arm that, in the open position projects into the holder into a position engageable with and movable by the block on insertion into the holder such that engagement of the conductor spreader block with the arm pivots the cover subassembly into the closed position, the arm being engaged between the blade contacts in the closed position.

3. The socket assembly defined in claim 1, further comprising:

a cable half clip forming the second half seat.

4. The socket assembly defined in claim 3, wherein the half clip has arms projecting transversely partly around the cable in the closed position, the assembly further comprising guide and latch means for guiding the half seat and retaining same on the subassembly in a position gripping the cable between the half seats.

5. The socket assembly defined in claim 4, wherein the subassembly further has a leaf spring forming the latch means and securing the half clip on the subassembly in the gripping position, the spring having handling projections compressible to release the half clip from the subassembly and cable.

6. The socket assembly defined in claim 3, wherein at least one of the half seats is provided with a barb projecting into to the cable in the gripping position.

7. The socket assembly defined in claim 6, further comprising:

a latch connected to the conductor spreader block and engageable with the half clip to retain same in the gripping position.

8. The socket assembly defined in claim 3, further comprising:

a pivot pin on the housing near the open back side thereof and carrying the subassembly.

9. The socket assembly defined in claim 1 wherein the wire holder and the conductor spreader block are made of plastic.

10. The socket assembly defined in claim 9 wherein the housing and the cover assembly are made of metal.

* * * * *